United States Patent [19]

Saffrhan

[11] Patent Number: 4,740,110

[45] Date of Patent: Apr. 26, 1988

[54] PLATFORM GROUTING SYSTEM AND METHOD

[75] Inventor: Ray W. Saffrhan, Gretna, La.

[73] Assignee: Shell Offshore Inc., Houston, Tex.

[21] Appl. No.: 34,868

[22] Filed: Apr. 6, 1987

[51] Int. Cl.[4] ..... E02B 17/02; B63C 11/00

[52] U.S. Cl. ..... 405/225; 405/191; 405/227

[58] Field of Search ..... 405/169, 185, 190, 191, 405/195, 224, 225, 227; 114/312

[56] References Cited

U.S. PATENT DOCUMENTS

| | | | |
|---|---|---|---|
| 4,030,434 | 6/1977 | Pedlar et al. | 405/191 X |
| 4,214,843 | 7/1980 | Rohde | 405/225 |
| 4,682,913 | 7/1987 | Shatto et al. | 405/191 X |

*Primary Examiner*—David H. Corbin

[57] ABSTRACT

A system and method for grouting skirt piles in skirt sleeves at the bottom of a deep water offshore platform. A series of spaced apart grout inlets are located on the outer wall of each sleeve and are adapted to be engaged by the end of a flexible grout line by making use of an underwater vehicle to make the connection.

12 Claims, 4 Drawing Sheets

FIG. 4
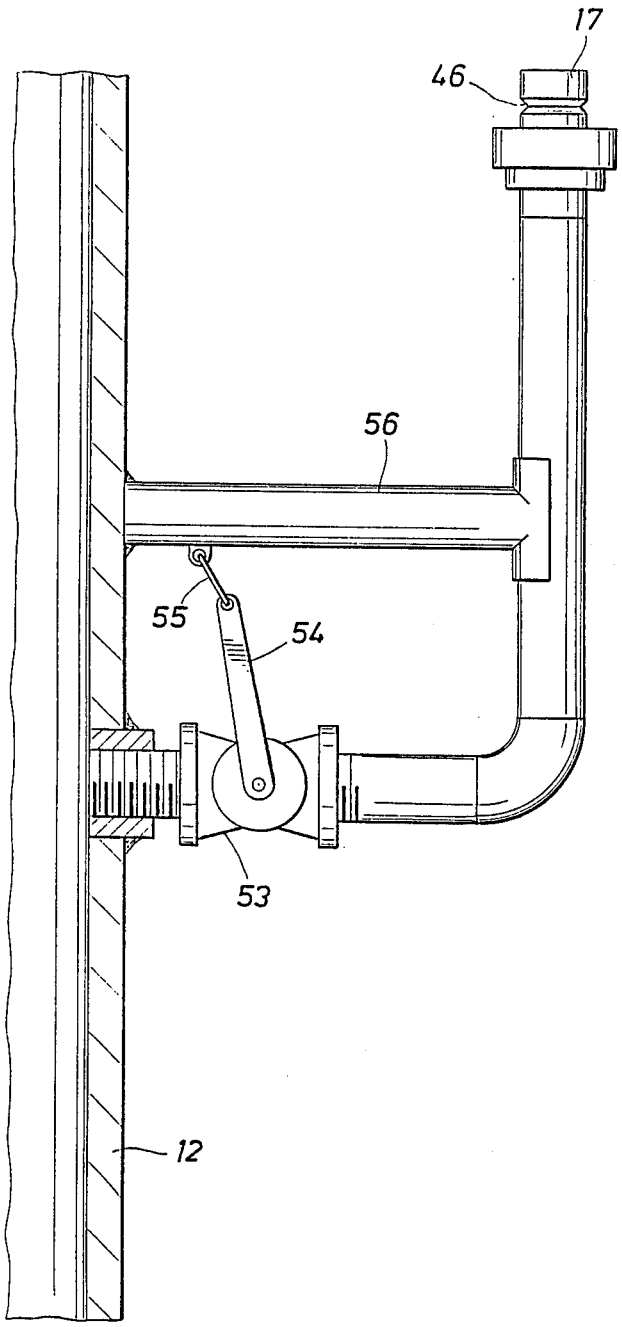
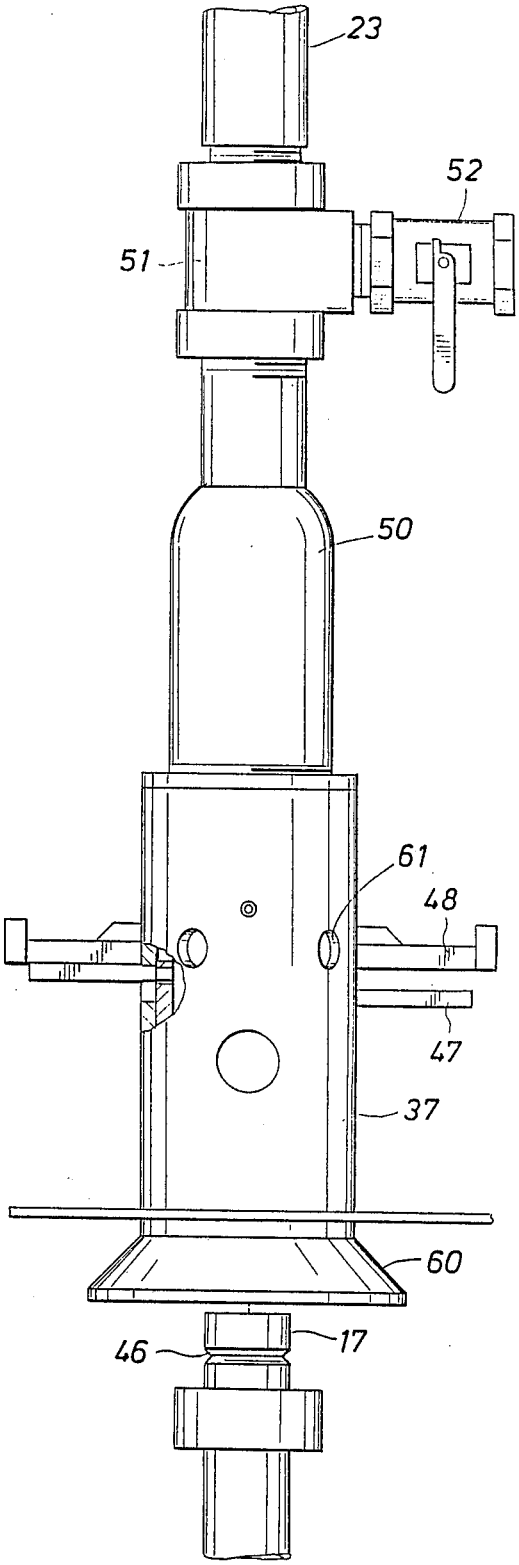
FIG. 5

PLATFORM GROUTING SYSTEM AND METHOD

This invention relates to a system and method for grouting skirt piles in skirt sleeves at the bottom of a platform to form a cement bond between the pile and the surrounding skirt so as to anchor the platform at a deep water location on the ocean floor.

BACKGROUND OF THE INVENTION

Offshore structures in the form of large offshore platforms are erected on the ocean floor for the purpose of drilling a large number of wells into the ocean floor in order to develop oil and/or gas fields. A platform may take the form of a rectangular structure with a plurality of legs extending from the ocean floor up to a point above the surface of the water where a platform is positioned on the top of the legs. In order to anchor the structure to the ocean floor and prevent its overturning, the structure is usually provided with a plurality of short skirt sleeves in the form of elongated cylindrical elements which may take the form of eight foot diameter pipes welded to the lower end of the platform and extending substantially parallel to the legs thereof. A smaller diameter tubular pile which may be, say, seven feet in diameter, is driven through the skirt sleeves as much as several hundred feet in the ocean floor. The pile above the skirt sleeve is cut off and the sleeve and pile are then cemented together.

The cementing of pile within the skirt sleeves may take many forms. In general, however, a common method is to have a cementing pipe, say, two inches in diameter, welded to each of the legs of the platform and extending from the top of the platform down to the lower end thereof where a lateral pipe is run to one or more of the closest pile sleeves which are outboard of the legs of the platform. After a pile has been driven through the skirt sleeve and cut off to the desired length, grout is pumped down the cement or grout line outside the leg and through the cross over lateral pipe which is in communication with the interior of the skirt sleeves. Since a smaller diameter pile is always used within a larger diameter skirt sleeve, and an annular space is formed between the pile and the sleeve which is filled with grout which is pumped down the two-inch grout line and into the annular space outside the pile. In waters up to 1,000 feet deep, divers may be sent down to inspect the operations or to open and close valves in the grout lines as needed. The use of divers in deeper waters is not generally feasible.

Another problem with the use of steel grout lines affixed to the legs of the platform is that in off-loading a platform from barges or hoisting it with a derrick barge, some of the grout lines may be damaged.

SUMMARY OF THE INVENTION

The present invention is directed to apparatus and a method for grouting a series of skirt piles in skirt sleeves attached to the bottom of a deep water platform. If desired, use may be made of normal grout lines running down the legs of the platform and arranged in communication with the interior of each of the skirt sleeves. In such an event the present invention would comprise the auxiliary system for cementing the piles of the sleeves in the event that the primary system failed.

However, it is a primary object of the present invention to do away with the generally-used grout pipes running down the legs of the platform and to use instead a flexible grouting hose which is connected to and lowered from a service barge equipped with the necessary supply of grout, a grout pump as well as one or more underwater remotely operated vehicle (ROVs) together with lowering wenches and control stations for the ROVs to be employed. Each of the skirt sleeves is provided with one or more valved grout inlet ports. Each port has one portion of a quick release connector attached to it or in communication with it which is of a form to mate with the other portion of the quick release connector which is carried at the lower end of the grout hose. Connections between the lower end of the grout hose and the grout inlet ports of the sleeves are made by means of an underwater vehicle (ROV) which preferably stabs the two portions of the connectors together. Thereafter, a slurry of grout is pumped down by means of a pump on the top of the barge, down through the hose and into the annular space formed between the pile and the surrounding pile sleeve. Pumping of cement into this sleeve is continued until the grout emerges from teh top of the sleeve. The density of the grout emerging from the top of the sleeve is monitored, as by means of a density instrument carried by an ROV, until a predetermined density of the grout has been obtained. The grout remaining in the grout hose is drained from it through a dump valve provided before the end of the hose is disconnected from the sleeve.

The underwater vehicle then disconnects the hose from the sleeve connector and flies through the water towing the flexible hose behind it so as to stab into a connector on each of the other pile sleeves of the structure. If desired, a series of grout inlet ports and connectors may be arranged vertically at spaced apart intervals along the pile sleeve which may be a hundred feet or more in height so that individual sections of the annular space within the sleeve may be separately grouted. Preferably, the grout hose is connected first to the lowermost grout inlet port into the sleeve so that the grout flows upwardly in the annular space within the sleeve and out the top thereof.

BRIEF DESCRIPTION OF THE DRAWINGS

These and other objects of the present invention will appear hereinafter from a consideration of the drawing and description.

FIG. 4 is a side view taken in partial cross-section of a valved grout inlet port and a portion of the quick release connector;

FIG. 5 is a schematic view of one form of a quick release connector;

DESCRIPTION OF A PREFERRED EMBODIMENT

Figures 1, 7:
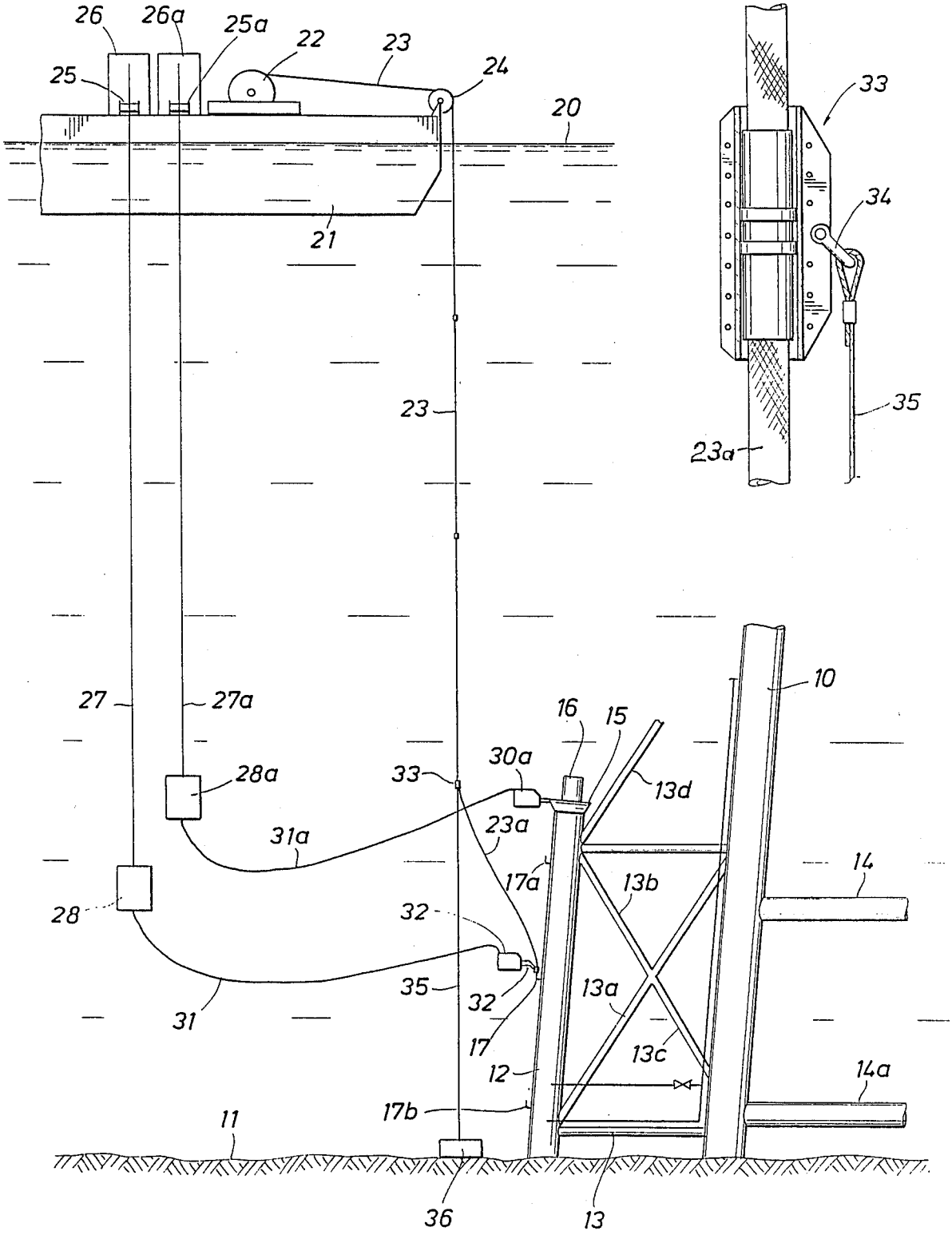
FIG. 1 is a schematic side elevation of one leg of a platform together with its outboard pile sleeve and illustrating a surface barge for supplying grout to an underwater location together with a pair of remotely operated vehicles arranged to carry out the underwater operations.
FIG. 7 is a view taken in partial cross-section of one form of a hose clamp to which an anchor line may be connected.

In FIG. 1 of the drawing, one leg 10 of an offshore platform is illustrated as being seated on the ocean floor 11. Outboard of the leg 10 is a skirt pile sleeve 12 which is ridgedly secured to the leg 10 and other members of the platform by cross-bracing members 13, 13*a*, 13*b*, 13*c* and 13*d*. Cross-braces 14 and 14*a* are merely illustrative of cross-braces which connect the adjacent legs together. The top of the pile sleeve 12 may be flared, as at 15, to aid in inserting the pile 16 therein. Arranged at spaced intervals along the pile sleeve 12 are a series of grout inlet ports which are provided with valves, if desired, and with one portion of a quick release connector 17, 17*a*, and 17*b*. For purposes of describing the present invention, it would be pointed out that the present invention was designed for a platform to be positioned in water depths of 1,000 feet or more. The pile sleeves may be considered to be made of pipe eight foot in diameter and extending 120 feet above the ocean floor 11. In turn, the pile 16 which has been driven through the skirt sleeve 12 would be seven foot in diameter. Positioned nearby on the surface of the water 20 is a cementing barge 21 which provides a grout or cement slurry for use in cementing the pile within the pile sleeve 12.

The barge 21 is provided with a single drum hydraulic wench 22 with a capacity for 2,000 feet or more of 2-inch grout hose 23. A hose sheave 24 is provided at the edge of the barge 21 to facilitate lowering the hose down through the water. The hose 23 preferably consists of a typical flexible grout hose in 100 foot lengths. It is preferred that the hose have an unrestricted two-inch diameter bore with a minimum working pressure of 1,000 psi. Preferably, the hose should also be capable of supporting its weight when deployed in the water from an anchored position on the surface barge 21. The barge is also equipped with a pair of cable wenches 25 and 25*a* for use in lowering ROV cages 28 and 28*a* down through the water to the approximate depth at which the underwater remotely operated vehicles 30 and 30*a* are to operate. The underwater vehicles 30 and 30*a* are connected to their respective cages 28 and 28*a* through tethers 31 and 31*a* which are adapted to transmit power through cables 27 and 27*a* to the vehicles 30 and 30*a* while returning signals back to the control stations 26 and 26*a* on the barge 21. Underwater vehicles of this type together with their cages and control stations are well known to the art and are merely used in carrying out certain portions of the method of the present invention. Each underwater vehicle is equipped with one or more manipulator arms for carrying out desired operations underwater together with TV cameras and lights for observing the operations.

In order to reduce the lateral movement of the grout hose 23 within the water due to currents, it is preferred that the grout hose 23 be equipped with a hose clamp 33 which is clamped on the hose at a suitable operating distance above the ocean floor, say 100 feet. While any suitable type of hose clamp may be employed, a split-sleeve type hose clamp 33 is illustrated in FIG. 7 which is provided with a shackle mount 34 by which a wire line 35 may be attached and extend downwardly to a clump weight on the ocean floor 11. The clump weight 36 may be of any suitable size depending upon the operating conditions but a 250 pound weight is generally sufficient. Thus, it may be seen that the wire line 35 between the clump weight 36 and the hose clamp 33 is held in tension together with the grout hose 23 extending from a hose clamp 33 to the barge 21. With this arrangement, lateral movement of the grout hose above the hose clamp 33 is substantially reduced. On the other hand, that portion of the grout hose 23*a* below the hose clamp 33 is entirely flexible and can be engaged by the underwater vehicle 30 and moved in any direction and in to any point desired.

Figure 2:
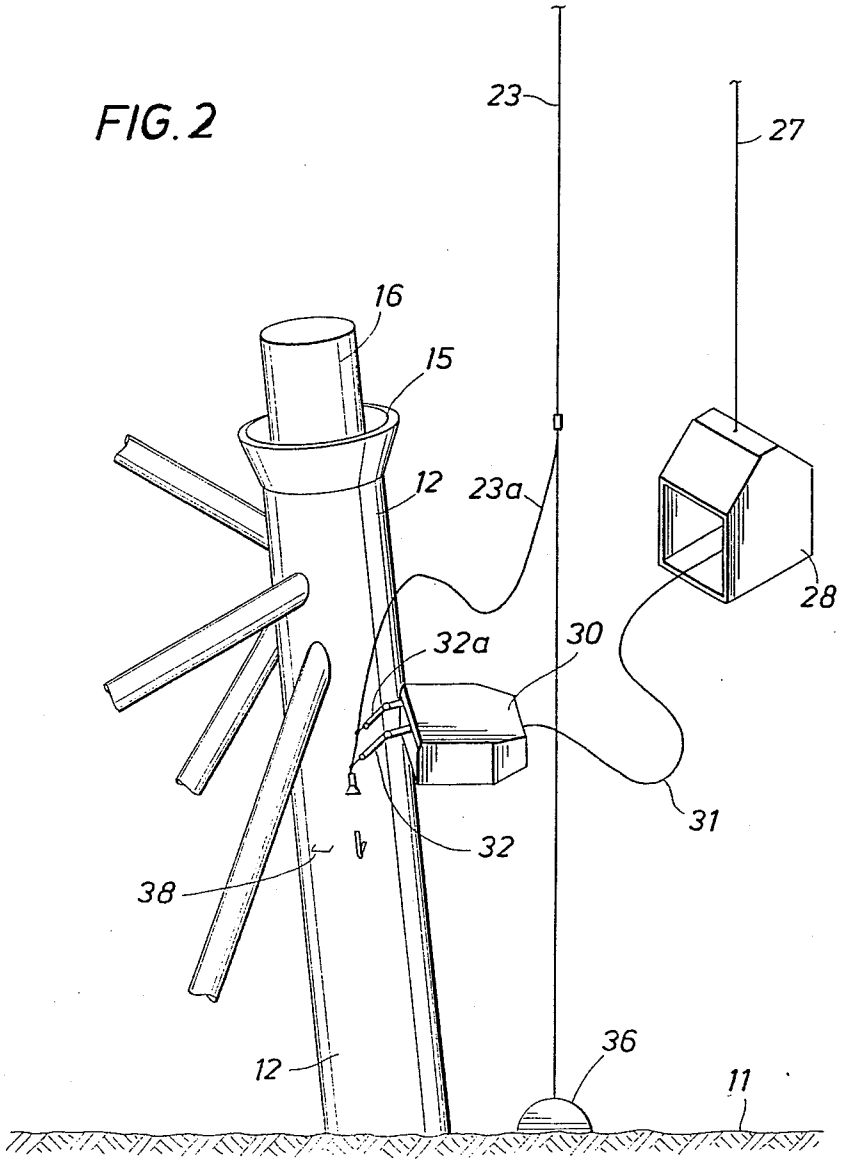
FIG. 2 is a diagrammatic view showing one of the underwater vehicles making a connection between a grout hose and a grout inlet port on the outside of the sleeve.

Referring to FIG. 2 of the drawings, the underwater vehicle 30 is shown as being provided with two flexible arms 32 and 32*a* which have engaged the flexible section 23*a* of the grout hose 23. The lower end of the flexible section 23*a* of the grout hose is provided with a portion of a quick release connector which is adapted to mate with the cooperating portion 17 of the connector which is rigidly attached to the outer surface of the sleeve. Thus, the remotely operated vehicle 30 is caused to fly downwardly in a line the moveable portion 37 of the connector with the fixed portion 17. If desired, a ROV grab ring 38 may be welded to the outer surface of the sleeve near the connector portion 17 so that one arm of the ROV can grab the ring 38 while the other arm stabs the connector portion 37 on the fixed connector 17.

Figure 3:
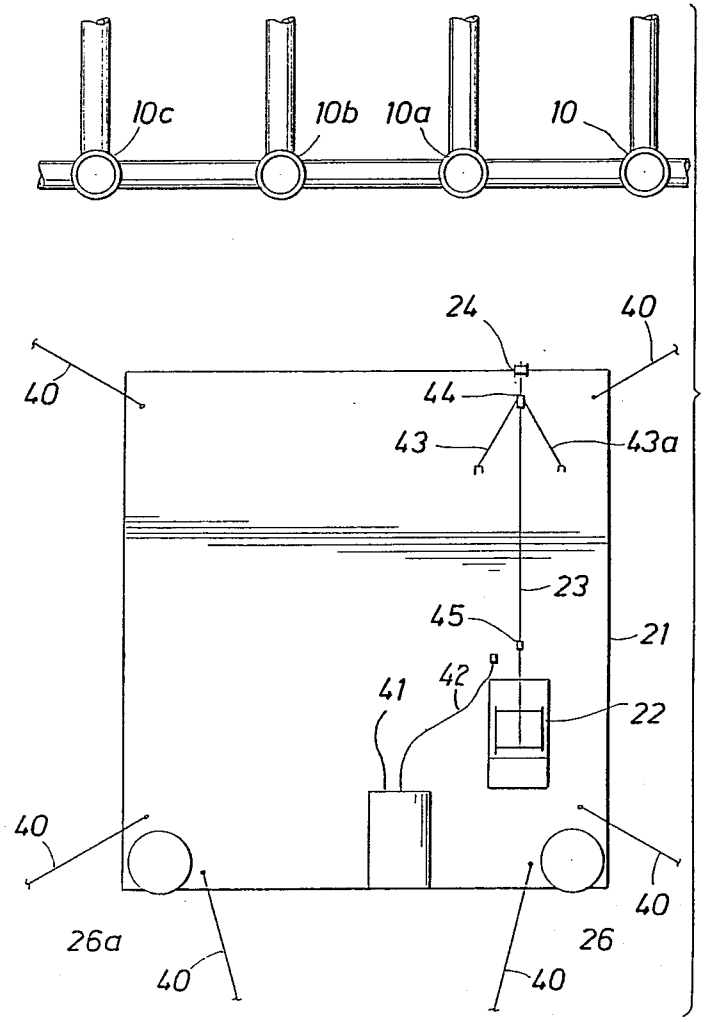
FIG. 3 is a plan view of a grout barge together with equipment for pumping grout to an underwater location.

Referring to FIG. 3 of the drawings, the barge 21 is shown with the hose sheave 24 facing a series of pile sleeves 10, 10*a*, 10*b* and 10*c* which are positioned along one side of the platform. The barge 21 is anchored in place by suitable anchor lines 40. The barge is provided with a grout pump 41 and a discharge line 42. A pair of hold back lines 43 and 43*a* are anchored to the deck of the barge and are arranged to engage a hose clamp 44 which may be similar in construction to the hose clamp shown in FIG. 7. After the necessary grout hose has been run off the hose wench 22 to the selected depth in the water, the hose clamp 44 is attached to anchor the hose 23 at that point. The hose 23 is then disconnected at a suitable point, say at numeral 43, and the grout line 41 is then connected directly to the grout hose 45. In FIG. 5, one form of a quick disconnector is illustrated with a male portion 17 being adapted to fit within the female portion 37 when forced thereon by the operating arm 32 of the underwater vehicle 30. The male portion of the connector 17 is provided with a locking groove 46 into which suitable latches, dogs, collet fingers or locking balls fit in the locked position. The female portion 37 of the connector is equipped with a release handle 47 which is adapted to be engaged by a claw at the end of the manipulator arm 32 of the ROV and squeezed against the stationary handle 48 so as to raise upwardly a locking sleeve within the connector portion 37. The handles 47 and 48 also give the ROV a chance to easily lift the connector section 37 off of the connector section 17. A reducer section of pipe 50 connects the female portion of the connector 37 to the grout hose 23 through a tee which has a dump valve connected to the outlet of the tee for emptying grout from a grout hose after the cementing operation has been completed. The dump valve 52 may be of any suitable type but is preferably of the plug cock type which opens or closes with a 90° movement of the handle and a handle that can be seen by a TV camera of an ROV so as to give an operator the condition of the valve.

Figure 6:
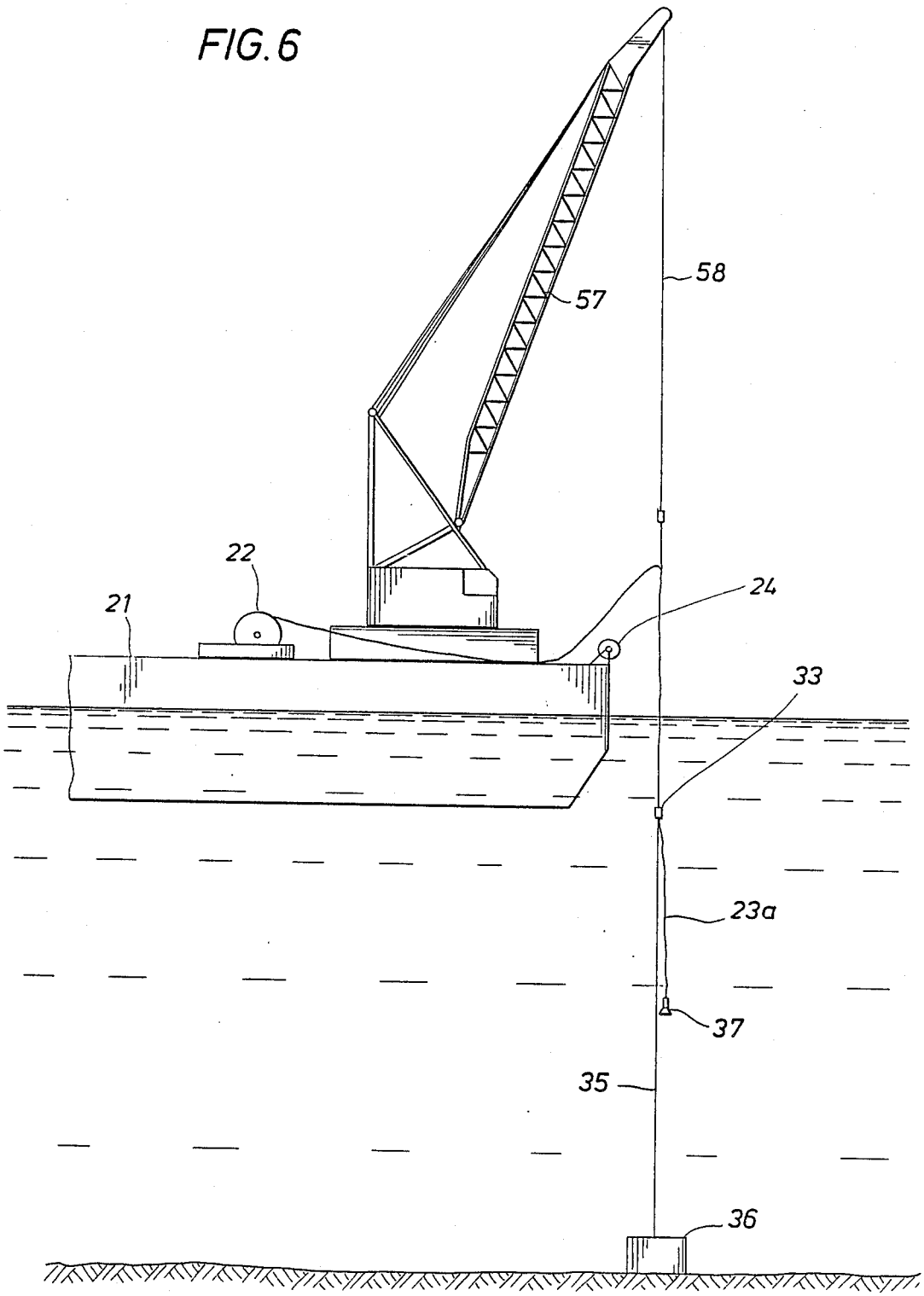
FIG. 6 is a diagrammatic view illustrating one means of lowering the grout hose and its tensioning weight from the barge.

The male portion of the connector 17 may be secured to the sleeve 12 in any suitable arrangement which may be vertically or horizontally directed. It is preferred that a valve 53 (FIG. 4) be inserted just outside the support in the wall of the sleeve 12 so that it can be selectively opened or closed as desired. Any suitable type of valve may be employed, for example, a unidirectional check valve may be employed to prevent cement from coming out of the pile sleeve 12 after cementing operations have been completed. Alternatively, a plug cock type valve as shown at 53 may be used having a handle 54 which is secured by a cable 55 to a cross base 56. Thus the valve may be protected when the equipment is being lowered to the ocean floor. Since it is more desirable to have a vertical stab of the female portion of the connector 37 onto the male portion 17, the male portion of the connector 17 is shown as being mounted vertically in FIGS. 4 and 5. For descriptive purposes the female portion of the connector is recited to be carried by the lower end of the grout hose. However, it is understood that the male and female portions of the connector may be interchanged on the equipment illustrated. As shown in FIG. 6, a crane 57 and its crane line 58 may be employed to lower the grout hose together with line 35 and clump weight 34 to the ocean floor.

Referring to FIG. 5 the female half of the connector 37 has a stabbing glag??? cone 60. The stabbing cone 60 has a downwardly directed flared opening and a vertical profile to aid docking or connection to the male portion of the connector. The weight of the female portion of the connector is sufficient to actuate the mechanical locking device of the connector 37 to lock the two halves of the connector together. A manipulator arm 32 on the underwater vehicle will be employed to increase the downward force on the female half of the connector unit in the event that this should prove necessary. The lock release handle 47, which extends radially outwardly for ease of engagement by the ROV operating arm 32, is provided on the female half of the connector. The position of the release handle 47 on the female portion of the connector provides a positive indication that the tool is actually locked into place. The two-inch dump valve 52 is provided above the female portion of the connector so that the connector can be relieved, prior to release from the sleeve 12, of the hydrostatic head of the cement column in the grout hose 23 and **23*a*** extending to the surface of the water.

Referring to FIG. 4, the preinstalled male connector portion 17 are welded to the outer surface of the skirt pile sleeves 12 at selected entry points to form cement grout entry ports into each sleeve. Careful consideration should be given to the location and orientation of each male connector unit 17 to minimize the chances of the tether 31 to the ROV 30 hanging up on the male connectors during lateral movement of the ROV 30 while stabbing the female connector portion 37 onto the male connector unit 17. The male half of the connector may be fitted with a protector plastic or rubber cap during the installation of the platform. The cap can be removed by the ROV manipulator arm 32 prior to making any connection.

In operation, each pile sleeve of the platform is provided with valved port means through the wall thereof to form concrete grout injection ports prior to lowering the platform to the ocean floor. After the platform has been positioned at a selected location on the ocean floor, a pile is driven through each of a selected number of pile sleeves into the ocean floor thereby forming an annular space between each pile and its surrounding sleeves. Grouting equipment including a grout pump is provided on a facility above the surface of the water at a point adjacent the platform. One end of a grout hose is lowered through the water from the facility into the vicinity of the skirt pile sleeve to be grouted. The upper end of the grout hose is connected to a grout pump 40 on the barge 21 and the connector 17 at the lower end of the hose **23*a* is connected to the mating portion 17 of the connector welded to the sleeve 12. Grout is then pumped down the hose 23 and through the port means in the sleeve 12** and into the annular space beween the sleeve and the pile until the annular space has been filled with grout with a selected minimum density.

Connecting and disconnecting the lower end of the hose to the sleeve to be grouted may be done by use of the remotely controlled underwater vehicle 30. The vehicle 30 or a second vehicle **30*a* may be employed and fly through the water to the top of the pile sleeve into which grout is being injected and flows out the top. The underwater vehicle 30*a* would be provided with a density measuring instrument which would be inserted into the grout at the top of the sleeve by the manipulator arm 32 of the vehicle 30 or 30*a*. After a density reading of a selected value has been obtained on the density measuring instrument and read at the control station 26 or 26*a*** of the underwater vehicles, pumping of the grout into the sleeve would be discontinued.

Prior to pumping grout into the sleeve, a manipulator arm 32 of an ROV would have cut the cable 55 (FIG. 4) holding the valve handle 54 in a closed position and the ROV arm would have opened the valve 53 so that grout could flow into the sleeve. After the cementing operation was completed for that sleeve, the valve 53 would be closed by the ROV. This operation would take place automatically without use of the ROV if the valve 53 were to be a check valve preventing escape of grout from the sleeve.

Prior to disconnecting the connector 17–37, the dump valve 52 (FIG. 5) in the grout line 23 above the connector portion 37 would be open so that grout in the grout hose 23 could be pushed out the dump valve 52 by water pressure and then the hose flushed out. Preferably the housing of the female connector portion 37 is provided with drain holes 61 so that any cement above the operating elements of the connector 37 could be flushed out before it is set up. Thereafter the discharge end of the grout hose with the female connector portion 37 would be disconnected from the male portion of the connector and the female portion of the connector would then be transferred to another male unit positioned outside the grout injection port of another pile sleeve. The above recited steps would then be carried out of pumping grout into the sleeve so that a concrete bond would be formed between each pile and its surrounding pile sleeve. This would be repeated for each of the sleeves and if desired at different levels on each of the sleeves.

Throughout the operation it is desirable to reduce the lateral movement of the upper and major portion of the length of the grout hose being suspended from the surface facility 21 while at the same time maintaining the lower portion of the grout hose in a manner so that it may be moved in any direction by an underwater vehicle 30 without any appreciable drag on the vehicle.

I claim as my invention:

1. A method of anchoring an offshore platform to the ocean floor in deepwater locations wherein said platform includes a plurality of skirt pile sleeves fixedly secured to the lower end of the platform around the periphery thereof, said method comprising:

providing each pile sleeve with valved port means through the wall thereof to form concrete grout injection port means, positioning the platform at a selected location on the ocean floor, driving a pile through each of a selected number of pile sleeves and into the ocean floor whereby an annular space is formed between each pile and its surrounding sleeve, providing grouting equipment including a grout pump on a facility above the surface of the ocean, lowering through the water from said facility into the vicinity of said skirt pile sleeves one end of a grout hose, connecting the upper end of said grout hose to said grout pump at the surface and the lower end of said grout hose to said valved port means in the wall of one of said pile sleeves, pumping grout down the grout hose and through the port means in the sleeve and into the annular space between the sleeve and the pile therein until the annular space has been filled with grout with a selected minimum density, closing the port means of said sleeve into which grout was injected, disconnecting the discharge end of said grout hose from said port means and successively transferring the hose to the grout injection port means of each pile sleeve to be grouted, and pumping grout thereinto whereby a concrete bond is formed between each pile and its surrounding pile sleeve.

2. The method of claim 1 including the steps of:

providing the lower end of the grout hose with one portion of a quick-release stab-type connector, providing a mating portion of said quick-release connector on each of said pile sleeves at the entrance of each of the grout injection port means, and stabbing the connector portion carried at the end of the grout hose into a mating connector portion in communication with one of said port means on a pile sleeve prior to pumping grout through said port means.

3. The method of claim 2 including the steps of:

providing a remotely-operated underwater vehicle having arm means, engaging said vehicle arm means with the connector portion at the lower end of the grout hose, flying the vehicle through the water while towing the connector portion and the grout hose attached thereto through the water to a selected connector portion on a pile sleeve, and bringing the mating connector portions into alignment with each other prior to stabbing the two together.

4. The method of claim 3 wherein the connector portions are male and female, with the female portion being carried at the lower end of the grout hose.

5. The method of claim 1 including the step of measuring the density of the grout near the top of the pile sleeve after it has substantially reached the upper end of the annular space between the pile and its surrounding pile sleeve.

6. The method of claim 5 including the steps of:

providing a second remotely-operated underwater vehicle having arm means together with a density-measuring instrument carried thereby, flying the second underwater vehicle to the top of the pile sleeve into which grout is being injected and flows out the top thereof, inserting the density-measuring instrument into the grout at the top of the sleeve, and discontinuing the pumping of grout into the sleeve after a density reading of a selected value has been obtained or the density-measuring instrument.

7. The method of claim 2 wherein the port means in the wall of each sleeve comprises a plurality of ports spaced apart vertically starting at a location near the lower end of the pile sleeve and including the step of connecting the lower end of the grout line to the lowermost port first and pumping grout into the sleeve through said port.

8. The method of claim 3 including the steps of:

reducing the lateral movement of the upper and major portion of the length of the grout hose being suspended from the surface facility, while maintaining the lower portion of the grout hose in a manner so that it may be moved in any direction by an underwater vehicle.

9. The method of claim 3 wherein a grout dump valve is provided in the grout hose above the connector portion at the end thereof, and including the step of emptying grout from the grout hose by opening the dump valve therein prior to disconnecting the end of the grout hose from a connector portion on a sleeve.

10. Apparatus for grouting piles in pile sleeves secured to the lower end of a deepwater offshore platform positioned on the ocean floor, said apparatus comprising:

port means through the wall of each pile sleeve for injecting grout into the annular space formed between each pile and its surrounding sleeve, a portion of a quick-release connector mounted on each pile sleeve in communication with each port means, a surface facility adjacent said platform containing a source of grout, grout pump means, a grout hose of a length sufficient to be lowered to the pile sleeves of the platform, wench means for lowering the grout hose, and wench means and a control station for operating and controlling underwater remotely-operated vehicle means used for observing and carrying out remote grouting operations adjacent the lower end of the platform, and underwater remotely-operated vehicle means having arm means, said grout hose having a portion of a quick-release connector carried at the lower end thereof, said portion being matable with a connector portion carried on each of said pile sleeves and being engageable with the arm means of said vehicle means to be carried thereby for hose connecting operations.

11. The apparatus of claim 10 including anchor means on the surface facility for anchoring the upper end of the grout hose thereto with the lower end of the grout hose positioned adjacent the lower portion of the platform.

12. The apparatus of claim 11 including weight means attached to the grout hose at a point above the lower end thereof so that the hose above that point is limited in its lateral movement while the hose below that point is free to be moved in any direction by the underwater remotely-operated vehicle.

* * * * *